United States Patent [19]

Magnan

[11] Patent Number: 4,686,921

[45] Date of Patent: Aug. 18, 1987

[54] FLEX WING APPARATUS

[75] Inventor: Jeffrey J. Magnan, San Clemente, Calif.

[73] Assignee: Gaastra Sails International Limited, Hong Kong

[21] Appl. No.: 594,476

[22] Filed: Mar. 28, 1984

[51] Int. Cl.[4] ..... B63H 9/06

[52] U.S. Cl. ..... 114/102; 114/94; 114/98; 114/103

[58] Field of Search ..... 114/39, 90, 102–104, 114/108, 97, 98

[56] References Cited

U.S. PATENT DOCUMENTS

| | | | |
|---|---|---|---|
| 721,286 | 2/1903 | Couch | 114/39 |
| 737,118 | 8/1903 | Laughlin | 114/98 |
| 2,077,685 | 4/1937 | Gerhardt | 114/103 |
| 2,561,253 | 7/1951 | Wells-Coates | 114/102 |
| 2,569,318 | 9/1951 | Kersten | 114/103 |
| 2,589,203 | 3/1952 | Nilsen | 114/103 |
| 3,141,435 | 7/1964 | Moffitt | 114/90 |
| 3,147,729 | 9/1964 | Barnard | 114/108 |
| 3,173,395 | 3/1965 | Laurent | 114/39 |
| 3,310,017 | 3/1967 | Dyer | 114/39 |
| 3,331,348 | 7/1967 | Dyer | 114/90 |
| 3,593,356 | 7/1971 | Schmalfeldt | 114/102 |
| 3,693,571 | 9/1972 | Hiscock | 114/102 |
| 3,768,426 | 10/1973 | Kratz . | |
| 3,795,215 | 3/1974 | Butler | 114/90 |
| 3,835,804 | 9/1974 | Jackson | 114/107 |
| 3,841,251 | 10/1974 | Larson | 114/39 |
| 3,866,558 | 2/1975 | Bergstrom | 114/90 |
| 3,877,406 | 4/1975 | Davis . | |
| 3,882,810 | 5/1975 | Roeser | 114/112 |
| 4,016,823 | 4/1977 | Davis | 114/90 |
| 4,064,821 | 12/1977 | Roberts | 114/103 |
| 4,149,482 | 4/1979 | Hoyt | 114/90 |
| 4,230,060 | 10/1980 | McCoy . | |
| 4,267,740 | 5/1981 | Hood | 114/90 |
| 4,335,669 | 6/1982 | Hackney . | |
| 4,388,888 | 6/1983 | Gushurst | 114/90 |
| 4,418,631 | 12/1983 | Frohbach | 114/39 |
| 4,463,669 | 8/1984 | Lineback | 114/140 |
| 4,479,451 | 10/1984 | Lucht | 114/104 |
| 4,625,671 | 12/1986 | Nishimura | 114/103 |

FOREIGN PATENT DOCUMENTS

| | | | |
|---|---|---|---|
| 0083432 | 12/1982 | European Pat. Off. | 114/104 |
| 3003529 | 8/1981 | Fed. Rep. of Germany | 114/102 |
| 384075 | 10/1983 | Fed. Rep. of Germany | 114/102 |
| 58-61091 | 4/1983 | Japan | 114/102 |
| 58-61093 | 4/1983 | Japan | 114/102 |
| 2097741 | 11/1982 | United Kingdom | 114/102 |

OTHER PUBLICATIONS

U.S. Ser. No. 591,435 of Mark S. Belvedere, filed Mar. 20, 1984.

*Primary Examiner*—Joseph F. Peters, Jr.
*Assistant Examiner*—C. T. Bartz
*Attorney, Agent, or Firm*—Pollock, Vande Sande & Priddy

[57] ABSTRACT

A flex wing apparatus comprising a support, a mast coupled to the support and a sail. Battens are carried by the sail, and couplings join the leading edge of the battens to the mast so that the sail and battens can pivot about the mast. The battens can be resiliently deformed varying magnitudes to induce the desired chamber into the battens and the sail.

15 Claims, 6 Drawing Figures

FLEX WING APPARATUS

BACKGROUND OF THE INVENTION

A flex wing apparatus is any apparatus which derives its support or motive power, in whole or in part, from a flexible wing. Example of flex wing apparati include sailboats, board sailing apparatuses, hang gliders and land sailing apparati.

The performance of a flex wing apparatus is dependent upon the efficiency of its flex wing. In order to tailor a flex wing for particular wind conditions, it is often necessary or desirable to adjust the camber of the wing.

For example, a sailboat or board sailing apparatus typically comprises a sail which is stiffened by resilient battens carried by batten pockets in the sail. The sail can be variably tensioned by an outhaul, and this can be used to provide some degree of camber adjustment in the sail. Unfortunately, however, when it is desired to increase the camber of the sail, the compressive forces on the battens push them forward around the sides of the mast thereby providing discontinuities in the wing and materially distorting the airfoil shape of the sail. This in turn reduces the efficiency of the sail and degrades performance.

In an effort to overcome this problem, it has been proposed to utilize a large, expensive mast of airfoil configuration and to couple the leading edges of the battens to the trailing edge of the mast. The mast is pivotable generally about its longitudinal axis, and with this arrangement, camber can be induced in the sail. However, in order to reduce the weight of this mast to an acceptable limit, it must be constructed of exotic expensive materials which make the cost of this construction very high.

SUMMARY OF THE INVENTION

This invention solves the problems noted above by providing a flex wing apparatus in which the desired camber can be induced into the wing. This is accomplished inexpensively using conventional inexpensive materials for the mast and without the need to construct the mast in an airfoil configuration.

With this invention, coupling means couples the battens to the mast for pivotable movement of the battens and sail about the mast. The battens can be resiliently deformed varying magnitudes to induce the desired camber into the battens and the sail. Because the leading edges of the battens are affixed to the mast, the leading edges of the battens do not project around the mast to disrupt the airfoil configuration of the sail. Moreover, because the leading edges of the battens can pivot generally about the longitudinal axis of the sail, they enable the battens and sail to assume the desired airfoil configuration. The mast can be of simple, easily constructed cross sections, such as a circular cross section.

The battens can be compressively deformed in various ways. For example, in one known form of windsurfer and sailboat, the mast is resilient, and the resilience of the mast can be used to deflect the battens. Alternatively, the tension in the sail, whether or not the mast is resilient, can be used to provide the force for deflecting the battens. The resilient deforming force can be controlled in the usual manner by an outhaul.

With this invention, the battens can support and tension the sail to a significant degree irrespective of wind conditions. This enables a sailboat or board sailing apparatus to sail closer into the wind and reduces or eliminates the tendency of the sail to luff.

In a preferred form of coupling, the coupling includes a collar for at least partially encircling a region of the mast and slidably cooperating therewith and a leg coupled to the collar and affixed to one of the battens. Preferably, the leg has a cavity for receiving an end portion of the associated batten. The cavity terminates in an end wall which forms a bearing surface for the leading end portion of the batten. The sail preferably has a sleeve at its leading edge, and the sleeve receives at least a portion of the mast and of the couplings. In a preferred construction, each of the couplings includes one or more wings for internally supporting the sleeve so that it retains the desired configuration.

The features of this invention are applicable to any flex wing apparatus as defined above. However, the features of this invention are particularly applicable to sailboats and board sailing apparatuses, and for this reason, the specific embodiment described hereinbelow is of a windsurfer.

The invention, together with additional features and advantages thereof may best be understood by reference to the following description taken in connection with the accompanying illustrative drawing.

DESCRIPTION OF THE PREFERRED EMBODIMENT

Figure 1:
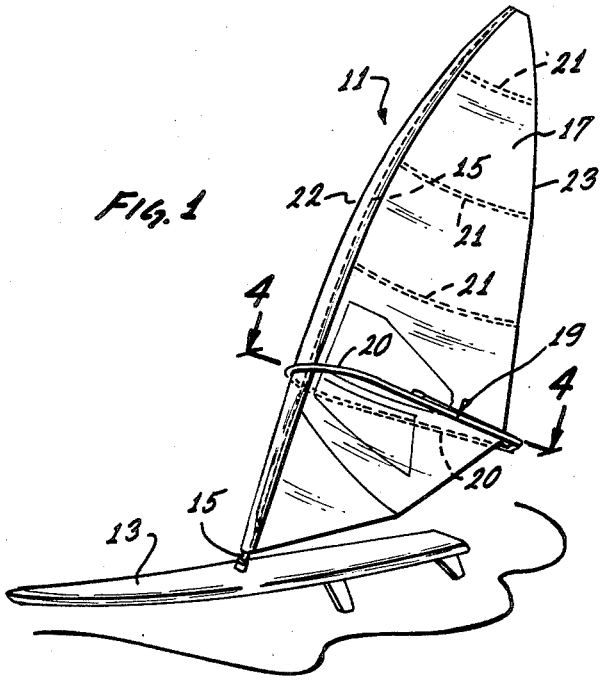
FIG. 1 is an isometric view of a windsurfer constructed in accordance with the teachings of this invention.

FIG. 1 shows a board sailing apparatus 11 which generally comprises a buoyant support 13 in the form of a surfboard 13, a mast 15 coupled to the support and projecting generally upwardly therefrom, a sail 17 and a boom 19 coupled to the mast. In the embodiment illustrated, the boom 19 is a wishbone boom having two arms 20 on opposite sides of the sail 17. The sail 17 is stiffened, and its shape is controlled, at least in part, by battens 21 carried by the sail.

Figure 2:
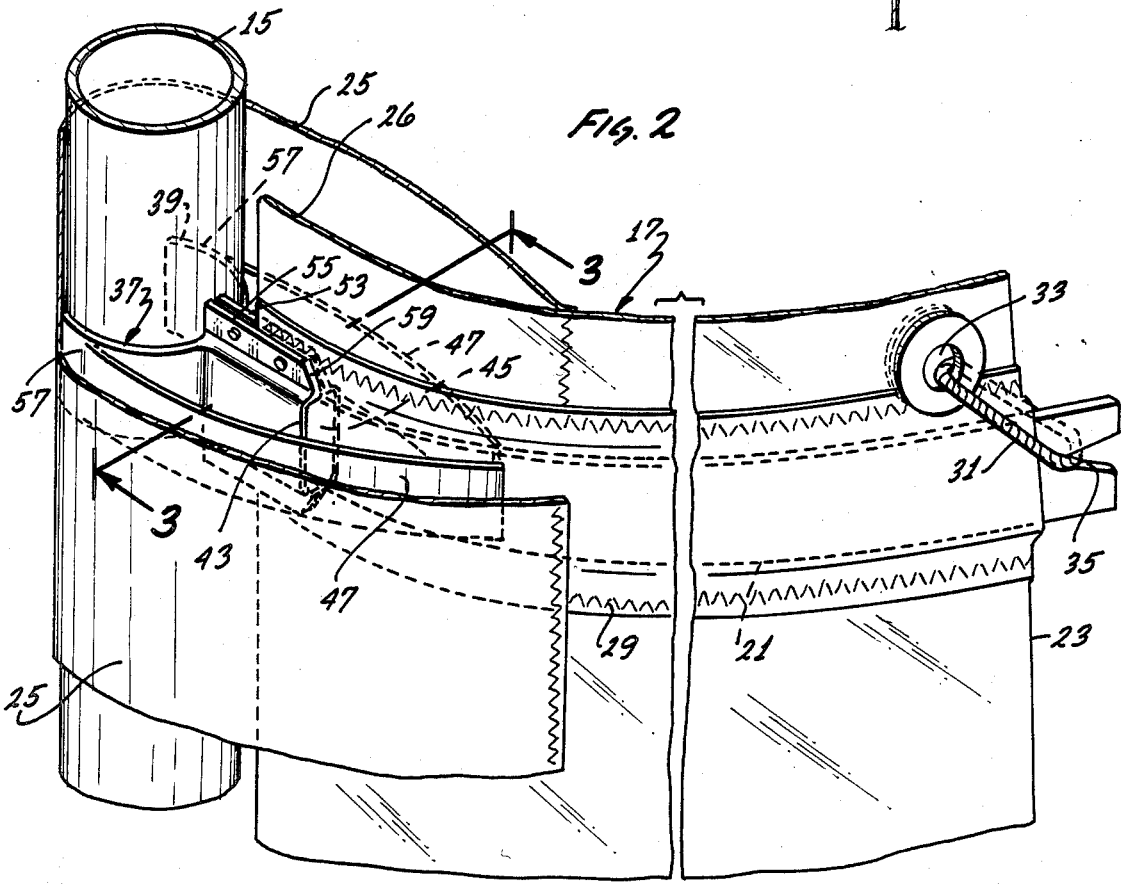
FIG. 2 is an enlarged, fragmentary, isometric view illustrating a section of the mast and adjacent regions of the sail and coupling.

The sail 17 has a leading edge 22, a trailing edge 23 and a sleeve 25 along its leading edge, and as shown in FIG. 2, the sleeve 25 may be sewed onto a main portion of the sail with a flap portion 26 of the sail being within the sleeve. The mast 15 is received within the sleeve 25 as shown in FIG. 2. The sail 17 may be rigged in accordance with conventional practice, and except for the construction along and within the sleeve 25, the windsurfer 11 may be of conventional construction.

The mast 15 is cylindrical and resilient and may be constructed of fiberglas or aluminum. As shown in FIG. 1, the mast 15 is curved rearwardly as it extends upwardly. Masts of this type are known, and such curvature is induced by tensioning the sail 17 using a conventional outhaul 27 (FIGS. 4 and 5) which couples the sail to the boom 19. Thus, the outhaul 27 controls the tension in the sail 17 and the deflection of the mast 15.

The leading end portion of each of the battens 21 is of reduced cross section so that such portion is more flexible. Each of the battens 21 is suitably carried by the batten 17, and this can be accomplished by a sail pocket 29 on the sail 17 which extends from the trailing edge 23 to a location within the sleeve 25 and adjacent the leading edge 22 of the sail. One batten 21 is provided in each of the batten pockets 29 in the usual manner, and the trailing end of each batten is suitably affixed to the sail as by a resilient, endless cord 31 (FIG. 2) which extends through an eyelet 33 in the sail 17 adjacent the trailing edge 23 and through a notch 35 in the trailing edge of the batten.

Figure 4:
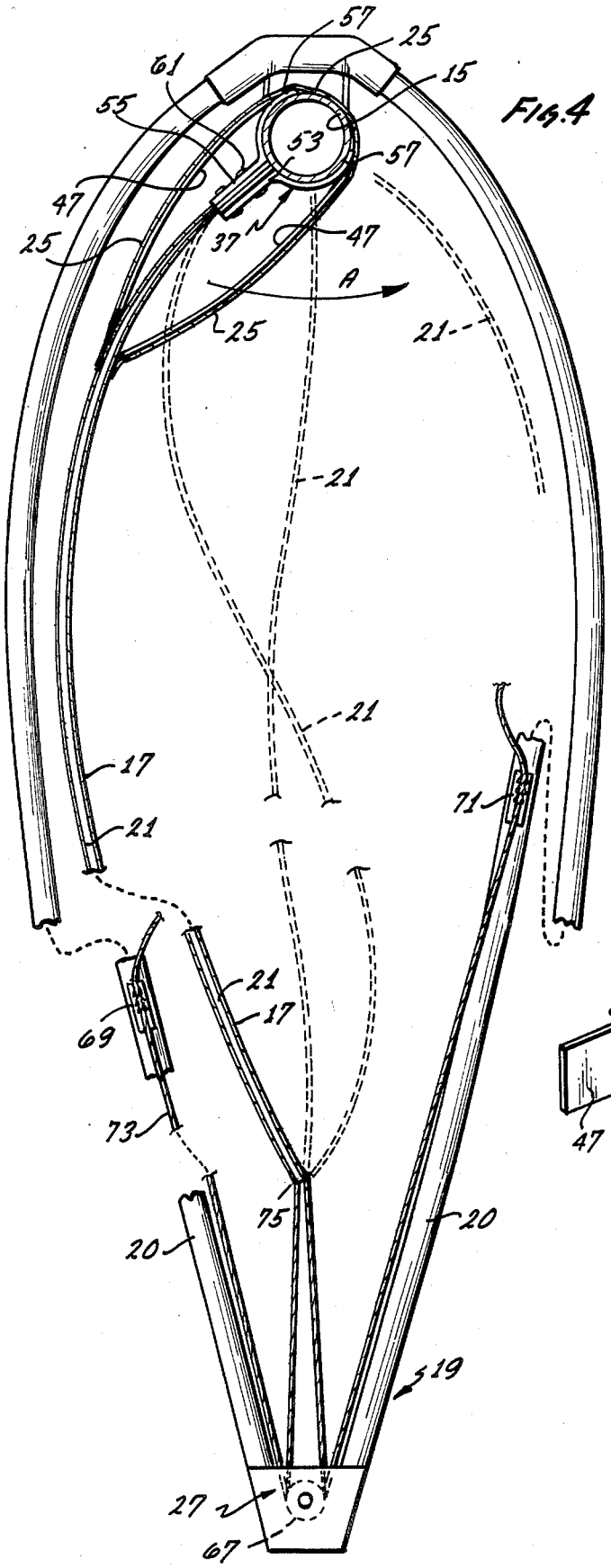
FIG. 4 is a sectional view taken generally along line 4—4 of FIG. 1.
Figure 5:
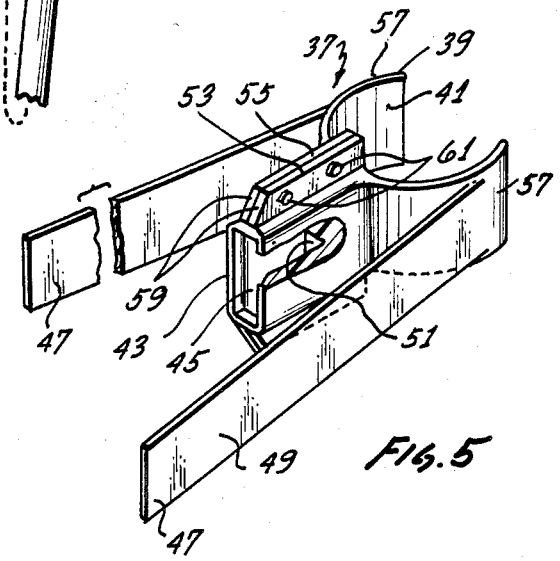
FIG. 5 is an isometric view of a preferred form of coupling.

The leading end portion of the batten 21 and the pocket 29 project into the sleeve 25. The leading ends of the battens 21 are coupled to the mast 15 by identical couplings 37 located within the sleeve 25. The coupling 37, which may be molded from a suitable plastic material, comprises a collar 39 of generally part-cylindrical configuration having a part-cylindrical inner surface 41, a leg 43 coupled to the collar and having a cavity 45 therein opening away from the collar. The coupling also has resilient wings 47 in the form of elongated slats coupled to the collar 39 on opposite sides of the leg 43 and extending generally in the same direction as the leg 43. In the embodiment illustrated, the wings 47 project substantially beyond the end of the leg 43 and they lie generally in the same plane. The wings 47, in the embodiment illustrated, are essentially flat so as to have an outer flat surface 49 for internally supporting and shaping the sleeve 25 as shown in FIG. 4.

The leg 43 terminates inwardly in an end wall 51. Although the collar 39 in the embodiment illustrated extends for less than 360 degrees, it could, if desired, extend for a full 360 degrees. However, it preferably extends for at least about 180 degrees, and in the embodiment illustrated, it extends for slightly over 180 degrees. This enables the collar 39 to be snap-fit onto the mast 15.

Although the coupling 37 could be integrally constructed, in the embodiment illustrated, it comprises coupling sections 53 and 55 which are mirror images of each other. Each of the coupling sections comprises a collar section 57, a leg section 59 and one of the wings 47. The coupling sections 53 and 55 can be joined together with the leg sections 59 in confronting relationship in any suitable manner, such as by rivets 61 (FIG. 3) which extend between flanges 63 of the leg sections 59.

Figure 3:
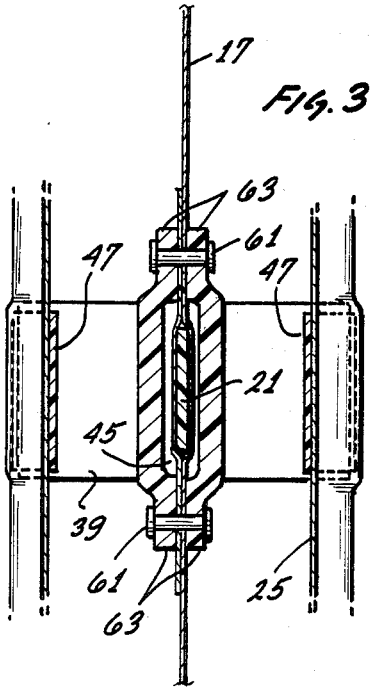
FIG. 3 is a fragmentary sectional view taken generally along line 3—3 of FIG. 2.

In use, the leading edge portion of one of the battens 21 is inserted into the cavity 45 until the batten bears against the end wall 51. More specifically, the coupling sections 53 and 55 are assembled over a portion of the sail 17 such that the leading end of the flap portion 26 within the sleeve 25 is clamped between the coupling sections (FIG. 2). The collar 39 can then be snap fit around a region of the cylindrical mast 15. The collar 39 is slidable on the mast 15 to allow pivotable movement of the coupling 37 generally about the longitudinal axis of the mast 15 relative to the mast. The wings 47 internally support the sleeve 25 as shown in FIGS. 2–4.

With this construction, the battens 21 and the leading edge of the sail 17 can pivot about the longitudinal axis of the mast 15. Because the leading edge of the battens 21 is captured by the couplings 37, and the couplings 37 pivot about the mast 15, the leading edges of the battens cannot disrupt the airfoil configuration.

Figure 6:
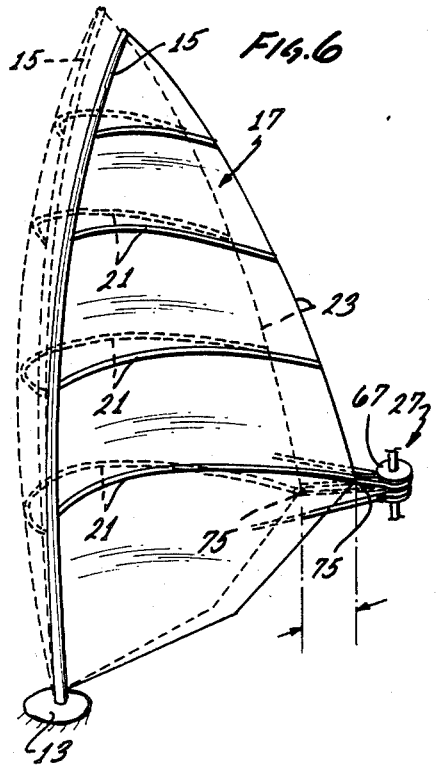
FIG. 6 is a somewhat schematic, isometric view of a sail illustrating one way that the camber of the sail can be changed.

The camber of the sail 17 can be induced and varied as shown in FIGS. 4 and 6 using the outhaul 27. The outhaul 27, which is conventional, comprises a double pulley 67 carried by the trailing end of the boom 19, cleats 69 and 71 mounted on the arms 20, respectively, of the boom 19, and a line 73 extending from the cleat 69 around one roller of the pulley 67, through an eyelet 75 at the trailing edge 23 of the sail 17, back around a second roller of the pulley 67 to the cleat 71. When the line 73 is tensioned, it draws the trailing edge 23 of the sail 17 closer to the pulley 67 at the trailing end of the boom 19, and this tightly tensions the sail between the mast 15 and the trailing end of the boom 19 with the result that the mast 15 is resiliently deflected rearwardly.

The camber of the sail 17 can be increased by loosening the outhaul 27 to allow the mast 15 to straighten somewhat and to move the eyelet 75 forwardly so that the mast and sail are in the dashed-line position of FIG. 4. This forward motion of the trailing edge 23 of the sail 17 pushes the trailing end of the battens 21 forwardly toward the mast. However, because the end wall 51 prevents forward motion of the battens, they deflect to increase their curvature and increase the camber of the airfoil formed by the sail 17. The couplings 37 slidably pivot clockwise as viewed in FIG. 4 about the mast 15 to allow the battens to increase the camber of the sail 17. If this pivoting motion of the couplings 37 about the mast 15 were not allowed, the battens would tend to buckle. The increased resilience of the leading end portions of the battens 21 enables them to impart the desired airfoil shape to the sail 17.

Conversely, to flatten the sail 17, the line 73 is further tensioned to pull the eyelet 75 rearwardly and to deflect the mast 15 rearwardly toward the full-line position of FIG. 4. This reduces the compressive forces on the battens 21. Accordingly, the couplings 37 pivot in the opposite direction about the mast 15 to permit a relative flattening of the airfoil shape of the sail. Here again, the pivoting movement of the coupling 37 about the mast 15 enables the camber of the sail 17 to be properly decreased. The resilient wings 47 are deflected by the tensioned sleeve 25, and these wings internally support the sleeve 25 so that it has the desired teardrop shape. In coming about, the battens 21 can deflect as shown in FIG. 4, and the coupling 37 pivots on the mast 15 in the direction of the arrow "A."

Although an exemplary embodiment of the invention has been shown and described, many changes, modifications and substitutions may be made by one having ordinary skill in the art without necessarily departing from the spirit and scope of this invention.

I claim:

1. A flex wing apparatus comprising:

a support;

a mast coupled to the support and projecting therefrom;

a sail of flexible material, said sail having a leading edge and a trailing edge;

a plurality of resilient battens;

means on the sail for carrying the battens with the battens extending toward the leading edge of the sail;

first and second couplings for coupling first and second of the battens, respectively, to the mast for pivotal movement of the battens and sail about the mast, each of said first and second couplings including means for at least partially surrounding a region of the mast and pivotable about the mast, said first and second couplings resisting movement of the first and second battens toward said leading edge;

said first and second couplings being free of interlocking driving engagement with each other in the pivotable movement of the first and second couplings about the mast; and means for resiliently deforming the battens varying magnitudes to induce the desired camber into the battens and the sail.

2. An apparatus as defined in claim 1 wherein said surrounding means includes a collar for at least partially encircling a region of the mast and a leg coupled to said collar and to the associated batten.

3. An apparatus as defined in claim 2 wherein said leg has a cavity for receiving an end portion of said the associated batten and an end wall at least partially defining said cavity for engaging the leading end of the associated batten.

4. An apparatus as defined in claim 1 wherein said sail has a sleeve at its leading edge and said sleeve receives at least a portion of said mast and said couplings.

5. An apparatus as defined in claim 4 wherein at least a first of said couplings are within said sleeve, said first coupling has at least one leg coupled to the surrounding means and to said sail.

6. An apparatus as defined in claim 1 wherein said support includes a buoyant structure capable of floating on water.

7. An apparatus as defined in claim 1 wherein said batten carrying means includes a plurality of batten pockets on said sail and means for coupling the trailing end of the sail to the battens whereby said battens are retained between the associated couplings and said coupling means.

8. An apparatus as defined in claim 1 wherein said deforming means includes said mast.

9. An apparatus as defined in claim 1 wherein at least a first of said couplings has a collar only partially encircling a region of the mast, said region of the mast is circular, said collar is slidably pivotable about said region of the mast and is capable of being snap-fit onto the mast.

10. An apparatus as defined in claim 1 wherein at least a first of said couplings comprises first and second coupling sections, each of said coupling sections includes a collar section for partially encircling a region of the mast and a leg section coupled to said collar section and means for joining said coupling section together with said leg sections forming a pocket for receiving an end portion of one of said battens.

11. An apparatus as defined in claim 4 including means on said coupling for internally supporting said sleeve.

12. An apparatus as defined in claim 4 including a resilient wing coupled to said surrounding means.

13. An apparatus as defined in claim 4, wherein at least one of said couplings includes first and second resilient wings coupled to the surrounding means, said wings being within said sleeve and being adapted to internally support the sleeve.

14. A flex wing comprising a mast, a sail of flexible material having a leading edge, a plurality of resilient battens, means on the sail for carrying the battens with the battens extending toward the leading edge of the sail, coupling means for coupling the battens to the mast for pivotal movement of the battens and sail about the mast, the coupling means including a plurality of couplings, each of the couplings having a collar at least partially surrounding the mast and rotatable about the mast and at least one leg coupling to the collar, said couplings being free of interlocking driving engagement with each other in the rotatable movement of the couplings about the mast, and the coupling means also including means for coupling the legs to the sail with the legs being adjacent associated battens with the couplings resisting forward movement of the battens, and means for resiliently deforming the battens varying magnitudes to induce the desired camber into the battens and the sail.

15. A flex wing as claimed in claim 14 in which the leading edge of the sail has a luff sleeve for receiving the mast and the coupling means.

* * * * *